US006344246B1

(12) United States Patent
Fischer et al.

(10) Patent No.: US 6,344,246 B1
(45) Date of Patent: Feb. 5, 2002

(54) LASER IRRADIATION INDUCED NON-SKID SURFACE LAYER FORMATION ON SUBSTRATE

(75) Inventors: Eugene C. Fischer, Stevensville; Vincent J. Castelli, Severna Park, both of MD (US); Dale A. Sowell, Falls Church, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/567,537

(22) Filed: May 10, 2000

(51) Int. Cl.[7] ..... C23C 14/30

(52) U.S. Cl. ..... 427/596; 427/597; 427/292; 427/532; 427/554; 427/556

(58) Field of Search ..... 427/597, 292, 427/455, 596, 554, 376.3, 376.4, 376.6, 393.7, 556, 532; 106/14.05, 14.44, 623, 632, 634, 635, 482, 483, 486, 487

(56) References Cited

U.S. PATENT DOCUMENTS 4,744,725 A * 5/1988 Matarese et al. ..... 415/172 A
4,917,960 A * 4/1990 Hornberger et al. ..... 428/550
5,160,537 A 11/1992 Terrat et al.
5,411,770 A 5/1995 Tsai et al.
5,435,889 A * 7/1995 Dietrich ..... 216/63
5,449,536 A 9/1995 Funkhouser et al.
5,565,023 A 10/1996 Sereboff
5,585,143 A * 12/1996 Scharf et al. ..... 427/224
5,620,552 A * 4/1997 Denney ..... 156/272.2
5,691,004 A * 11/1997 Palazzolo et al. ..... 427/455
5,759,641 A 6/1998 Dimitrienko et al.
5,912,057 A 6/1999 Nishimura et al.
5,952,057 A 9/1999 Parks
6,007,876 A 12/1999 Niino
6,017,591 A * 1/2000 Popoola et al. ..... 427/449

* cited by examiner

*Primary Examiner*—Shrive Beck
*Assistant Examiner*—Eric Fuller
(74) *Attorney, Agent, or Firm*—Jacob Shuster

(57) ABSTRACT

Robotic cladding of an underlying substrate with a composite metallic surface layer on a prepatterned interface with the substrate, is performed by a laser induced surface improvement process whereby a particulate ceramic additive introduced into a matrix mixture forms the surface layer with a permanent non-skid property bonded by intermixing of molten portions of such matrix mixture and the substrate at the interface, enhanced by prepatterning of such interface.

4 Claims, 1 Drawing Sheet

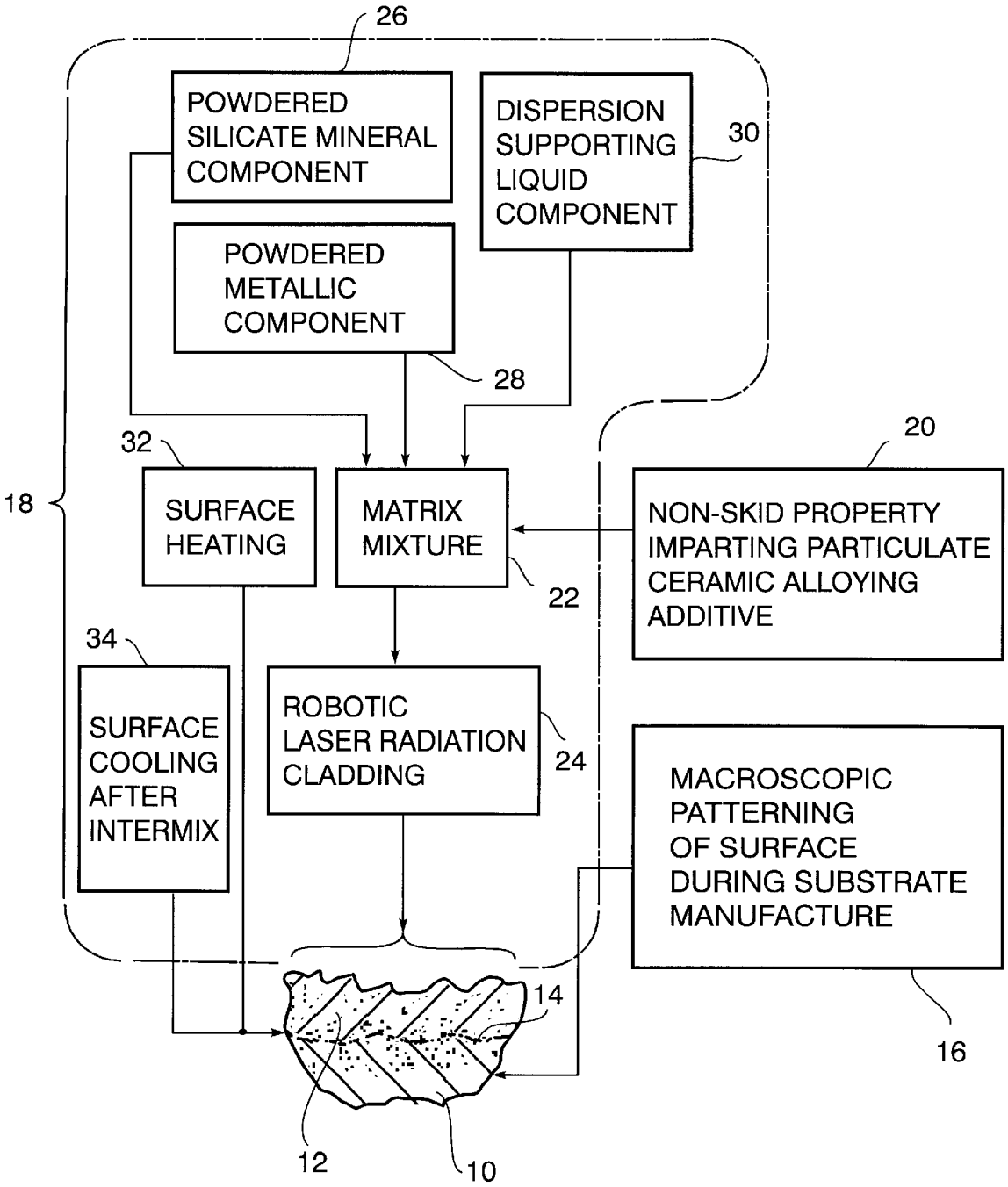
26
POWDERED SILICATE MINERAL COMPONENT
DISPERSION SUPPORTING LIQUID COMPONENT
30
POWDERED METALLIC COMPONENT
28
32
20
18
SURFACE HEATING
MATRIX MIXTURE
NON-SKID PROPERTY IMPARTING PARTICULATE CERAMIC ALLOYING ADDITIVE
22
34
SURFACE COOLING AFTER INTERMIX
ROBOTIC LASER RADIATION CLADDING
24
MACROSCOPIC PATTERNING OF SURFACE DURING SUBSTRATE MANUFACTURE
14
16
12
10

LASER IRRADIATION INDUCED NON-SKID SURFACE LAYER FORMATION ON SUBSTRATE

The present invention relates in general to a method of providing a non-skid surface on an underlyin substrate.

BACKGROUND OF THE INVENTION

Non-skid surface coating materials are presently utilized for treatment of metallic substrates, such as the steel decks of Naval aircraft carriers. Such surface coatings require frequent replacement because they are only moderately corrosion resistant and unacceptably degradable in so far as their non-skid properties are concerned. Furthermore, removal of such surface coatings for replacement thereof generates huge labor costs and large amounts of hazardous waste materials. It is therefore an important object of the present invention to provide the metallic substrate deck of an aircraft carrier or the like with a non-skid surface that is both non-corrosive and long-lasting, so as to avoid replacement. A further object resides in improvement of the heat transfer property associated with the substrate.

SUMMARY OF THE INVENTION

In accordance with the present invention, a metallic or ceramic substrate is bonded at an interface to a surface material layer formed from a composite matrix mixture having a metallic content produced and applied to the interface by an appropriately modified laser irradiation induced surface improvement process. Such laser inducement process involves use of noble metal and ceramic abrasive components in the composite matrix mixture from which the surface layer is formed by robotic cladding of the interface on the underlying metal or ceramic substrate that was previously prepatterned. The surface layer acquires a long-lasting non-skid property by alloying the matrix mixture with an additive such as a particulate ceramic, introduced thereto before cladding and intermixing with portions of the substrate at the interface during the laser induced process to enhance bonding to the substrate prepatterned at the interface.

BRIEF DESCRIPTION OF DRAWING

A more complete appreciation of the invention and many of its attendant advantages will be readily appreciated as the same becomes better understood by reference to the following detailed description when considered in connection with the accompanying drawing herein:

The drawing consists of a single FIGURE diagramming the process of the present invention applied to a substrate illustrated by partial section in chemically bonded relation to a surface layer.

DETAILED DESCRIPTION OF PREFERRED EMBODIMENT

Referring now to the drawing in detail, a process is diagrammed for providing a metallic subsurface 10, such as the steel deck of an aircraft carrier, with a non-skid surface formed by a layer of composite material 12 chemically bonded at a macroscopic patterned interface 14 to the substrate 10. Such interface 14 is prepattemed during substrate manufacture, as denoted by reference numeral 16. The layer of material 12 is produced and bonded to the substrate 10 in accordance with a laser induced surface improvement method 18, already developed and disclosed in U.S. Pat. No. 5,952,057 to Parks, as also diagrammed in the drawing. In addition to the non-skid property imparted to the substrate by macroscopic patterning thereof prior to treatment, pursuant to the present invention a non-skid property is imparted to the otherwise non-corrosive type of material layer 12, by introduction of an additive 20 such as crystalline abrasives (carbide, suicides, Nitrides, oxides) to a matrix mixture 22 of Nobel metal powders utilized in such process, prior to cladding by robotic laser radiation, denoted as 24 in the drawing. Surface heating 32 during such cladding effects melting of the mixture 22 and intermixing thereof as well as to remove any organic liquid binder material used to temporarily affix the matrix to the substrate prior to treatment. The process is completed by cooling 34 at the interface 14 between the substrate 10 and layer 12 for hardening of the metallurgically bonded intermixture of the interfaced portions of the substrate and surface layer materials.

The foregoing referred to laser induced surface improvement method 18 involves use of a powdered silicate material component 26 and a powdered metallic component 28, together with a liquid component 30 for supporting dispersion of the powder components in order to form a Noble metallic combination with the additive 20 introduced into the matrix mixture 22. The additive 20, such as a particulate ceramic alloyed into the layer 12 significantly imparts thereto a permanent frictional and wear-resistant characteristic preventing skidding of aircraft for example on a steel deck type of substrate 10 having its interface 14 previously patterned so as to enhance bonding as well as to provide an improved non-skid property through drainage of liquids such as rain and oil from the substrate.

In view of the foregoing described introduction of additive 20 into the matrix mixture 22 melted during application by the laser induced surface improvement process 18, and the prior roughened formation of the substrate patterned interface 14, non-skid property maintenance of an aircraft deck has been prolonged for the life of the aircraft. Additionally, fire hazards are avoided and hazardous emissions such as volatile organic carbon produced during cladding of the substrate surface material under current environmental exposure is eliminated. The hazards heretofore experienced by frequent replacement of non-skid substrate surface coatings, are also thereby avoided. Furthermore, because of the metallic content of the surface layer 12, it may be welded to other metallic substrates or at the seams (edges) of large steel plate stock so as to form a continuous, structurally sound metallic deck of an aircraft carrier.

Obviously, other modifications and variation of the present invention may be possible in light of the foregoing teachings. It is therefore to be understood that within the scope of the appended claims the invention may be practiced otherwise than as specifically described.

What is claimed is:

1. A method of forming a non-skid surface on a substrate comprising the steps of:

a) roughening said surface throughout to enhance establishment of a non-skid surface property;

b) selecting a metal containing matrix material;

c) selecting an abrasive additive;

d) mixing said additive with said matrix material to form a mixture;

e) applying said mixture to said roughened surface; and f) cladding said mixture onto said surface by laser irradiation to form the non-skid surface on said substrate.

2. The process as defined in claim 1, wherein said additive is a crystalline abrasive particulate ceramic that is alloyed with the matrix material in a layer under conditions of the laser irradiation cladding applied to the substrate, which also improves thermal conductivity of the layer.

3. The process as defined in claim 1, wherein said non-skid surface on the substrate is a metallic deck of an aircraft carrier.

4. A method of producing a metallic surface on an underlying supporting substrate, comprising the steps of:

a) prepatterning the substrate during manufacturing thereof to enhance establishment of a non-skid surface property;

b) select a metal containing matrix material;

c) select a crystalline abrasive as an additive to be introduced into said matrix material to impart the non-skid surface property;

d) mixing said additive with said matrix material to form a mixture;

e) applying said mixture to said prepatterned surface; and f) cladding said mixture onto said surface by laser irradiation to form said non-skid property on said metallic surface.

* * * * *